US010155308B2

(12) United States Patent
Wysong

(10) Patent No.: US 10,155,308 B2
(45) Date of Patent: Dec. 18, 2018

(54) STRONG, LIGHTWEIGHT, FOLDING WOODEN SAWHORSE

(71) Applicant: Harvey Wysong, Chattanooga, TN (US)

(72) Inventor: Harvey Wysong, Chattanooga, TN (US)

( * ) Notice: Subject to any disclaimer, the term of this patent is extended or adjusted under 35 U.S.C. 154(b) by 0 days.

(21) Appl. No.: 14/757,351

(22) Filed: Dec. 21, 2015

(65) Prior Publication Data

US 2016/0176040 A1 Jun. 23, 2016

Related U.S. Application Data

(60) Provisional application No. 62/124,459, filed on Dec. 19, 2014.

(51) Int. Cl.
*B25H 1/04* (2006.01)
*B25H 1/06* (2006.01)

(52) U.S. Cl.
CPC ..... *B25H 1/06* (2013.01); *B25H 1/04* (2013.01)

(58) Field of Classification Search
CPC .... B25H 1/06; B25H 1/02; B25H 1/14; B25B 1/22; B25B 1/2484
USPC ..... 269/16, 134–138, 291, 289 R
See application file for complete search history.

(56) References Cited

U.S. PATENT DOCUMENTS 4,429,765 A * 2/1984 Garcia ..... B25H 1/06 182/153
4,640,386 A * 2/1987 Hall ..... B25H 1/06 182/155
D308,728 S * 6/1990 Carlson ..... D25/67
5,052,308 A * 10/1991 Brown ..... A47B 3/02 108/115
5,305,850 A * 4/1994 McQuiston ..... B25H 1/06 182/151
2009/0242329 A1* 10/2009 Krauss ..... B25H 1/06 182/153
2011/0240404 A1* 10/2011 Woodard ..... B25H 1/04 182/181.1

* cited by examiner

*Primary Examiner* — David Bryant
*Assistant Examiner* — Nirvana Deonauth
(74) *Attorney, Agent, or Firm* — Law Office of Van R. Irion

(57) ABSTRACT

A portable, lightweight, folding, wooden, sawhorse which utilizes precision wood joinery, wood screws, and glue to greatly increase vertical strength, lateral strength, and the rigidity of the sawhorse which significantly exceeds the vertical strength, lateral strength, and rigidity of larger, heavier sawhorses.

17 Claims, 4 Drawing Sheets

STRONG, LIGHTWEIGHT, FOLDING WOODEN SAWHORSE

CLAIM OF PRIORITY

The applicant claims for this application the priority date established by provisional patent application 62/124,459, filed on Dec. 19, 2014.

FIELD OF THE INVENTION

The present invention relates generally to an extremely strong, lightweight, folding wooden sawhorse with a sacrificial top rail.

BACKGROUND OF THE INVENTION

From the beginning of recorded history, workmen have devised tools to hold their work pieces steady to facilitate their work. The two tools best known for this are the sawhorse and the anvil. The instant invention pertains to improvements on the sawhorse.

The most important characteristics of the sawhorse are its strength (vertical and lateral) and its rigidity. In ages past strength and rigidity were achieved by fastening together massive pieces of lumber. And this was satisfactory for that age, since a carpenter may have worked for several years or even a lifetime on a single job site.

However, in the modern age the nature of a carpenter's (or other tradesman's) work has changed dramatically. Today, carpenters, remodelers, repairmen, and other tradesmen move frequently from one job to another—often spending less than a day on a job site. They still need sawhorses with strength and rigidity, but also require them to be portable.

Also, tradesmen working in multi-floor buildings, whether during construction or for repairs and remodeling, need to transport their tools from one floor to another, using either stairs or elevators. In either case, the need for portable sawhorses is evident.

The first component of portability is for the sawhorse to be lightweight.

The second component of portability is compactness. When a sawhorse can be folded, it becomes much more useful and much more valuable. The folded sawhorse passes easily though doorways and other narrow passages that greatly limit the use of non-folding sawhorses. Also, tradesmen need to optimize the use of space in their vans or trucks, and a folding sawhorse contributes to this.

Two other differences between the present age and ages past are the use of power tools—particularly the circular saw—and the use of sheet goods, such as plywood, OSB, MDF, plastics, etc. Today, workmen prefer to run their circular saws through the tops of the sawhorse as they cut sheet goods. It improves the quality of the work and increases the speed of work.

Another modern trend is the use of large quantities of granite, marble, and solid surface materials (e.g., Corian®) as counter tops. These structures must be given a final shaping at the job site to achieve precise fits. Having a strong, portable support structure close to the installation site is of vital importance, especially in new, high-rise construction.

Yet another difference between the present age and ages past is the DIY (Do-It-Yourself) trend. Today homeowners undertake many construction and home-repair tasks that were almost always performed by professionals just a few generations ago. So, the issue of compactness is of vital importance to homeowners, who must store the sawhorses in between uses.

In order for a sawhorse to be truly portable, it must be both lightweight and compact, two characteristics that are usually at variance with strength and stability. That is the challenge that this invention addresses.

There are several commercial solutions to sawhorse design. Typically, the top rail, which supports the workpiece, is an integral component of the sawhorse and vital to the structural soundness of the whole. One accidental pass with the circular saw can destroy the plastic, wooden, or sheet metal sawhorse. In sawhorses where the top rail is made of heavy steel or contains heavy steel components, running the circular saw into the top rail has been known to destroy the saw blade, destroy the saw, and even cause severe operator injury.

This design flaw was overcome by a solution known as the Shop Dog, which uses a disposable top rail. But the lumber used in the Shop Dog is 2×4, making it heavier than the present invention. The Shop Dog design typically includes components that are held together by nails or screws and glue, increasing weight and decreasing lateral strength, rigidity, and stability when compared to the present invention. The Shop Dog design incorporates a "trestle" design—a design in which the legs tilt inward at a 10° angle—in order to generate lateral stability. But that is not sufficient to achieve the levels of lateral strength and rigidity achieved by the present invention. The trestle design necessitates more complex cuts in the legs and stretchers. Also, it necessitates two different legs and two different stretchers. Because of the larger dimensions of the lumber, the Shop Dog is considerably heavier than the present invention. The Shop Dog design is too heavy, insufficiently rigid, too complex, and too expensive to be marketed successfully.

Other existing solutions attempt to increase portability by including a folding mechanism, but these solutions fail to meet the needs of the industry because they sacrifice strength and stability in order to gain portability.

Still other solutions attempt to improve storage efficiency by designing stackable sawhorses. However, these solutions are similarly unable to meet the needs of the industry because they sacrifice lateral stability in order to gain stackability, and their non-folding design renders them less portable and unsatisfactory for mobile tradesmen.

Still other solutions utilize fasteners alone to create vertical and lateral strength, but these fail to meet industry needs, because the fasteners loosen with use and the looseness weakens the sawhorse substantially.

Some currently available sawhorses attempt to increase strength by fabricating key components from heavy steel. This fails to meet industry needs, because it increases weight, and if a saw blade runs into the steel component, it can destroy the blade, destroy the saw, and cause severe physical injury to the operator.

Other attempts to use steel for folding sawhorses employ thin-gauge sheet metal. This does mitigate the increased weight associated with steel, but it creates a device that is too weak to support the typical workloads that workmen apply.

Another common attempt to satisfy industry needs is to manufacture folding sawhorses out of plastic. But plastic is not strong enough to support heavy weight, will shatter upon moderate impact, and will creep (sag) if it bears weight for long periods of time.

It would be desirable to have a sawhorse that possesses: 1) Vertical strength, 2) lateral strength, 3) rigidity, 4) impact resistance, 5) stability, 6) minimal weight, 7) the ability to fold into a compact size, 8) the ability to work in accord with today's modern power tools, 9) the ability to accommodate modern construction materials, and 10) characteristics that lend themselves to mass production so that consumers can afford to buy them. The instant invention addresses these issues.

SUMMARY OF THE INVENTION

For purposes of this application the following terms shall have the following meanings, unless specifically stated otherwise, or context clearly reflects a different meaning:

"Precision Wood Joinery" shall mean a tight interlocking wooden fit which prevents the relative movement of the joined pieces and does not depend on metal fasteners for the integrity of the joint. Precision wood joinery is commonly employed in building fine furniture. It includes, but is not limited to a dado (also known as a "housing"), half-lap joints, mortise & tenon joints, loose tenons, dowels, tongue & groove, dovetails, partially housed dovetails, miter joints, pocket screw joinery, and so forth.

The preferred embodiment of the instant invention utilizes interlocking dados for the joinery between the stretchers and the legs. Similar joinery, such as the mortise & tenon and loose tenon, can also be used. The preferred embodiment of the instant invention also utilizes screws to fasten the stretchers to the legs. However, the primary purpose of the screws is to provide a clamping force while the glue dries. Said joints are Precision Wood Joinery because the joints are not dependent upon the screws remaining in place.

"Two-by Lumber" shall mean the most common size of construction lumber in the United States, which has a width of approximately 1.5 inches. This cut of lumber is know as "two-by," because it is rough sawn in 2-inch widths before it is dressed down to a finished width of 1.5 inches.

The present invention advantageously addresses the aforementioned deficiencies by providing an extremely strong, lightweight, folding wooden sawhorse with a sacrificial top rail, which provides enormous vertical and lateral strength, a rigid structure, excellent impact resistance, a geometry that provides stability, minimal weight, a compact folded profile, the ability to work in accord with modem tools and materials, a design that lends itself to mass production, and that is suitable for the most demanding use by several industries and trades as well as homeowners.

The high strength, low weight, and foldable characteristics of the present invention combine to produce a sawhorse of greater safety, greater portability, and greater versatility. Often the workman's choice will be between the present invention or no sawhorse at all, because it is either inconvenient, unsafe, or impossible to take heavier, weaker, or non-folding sawhorses to the site at which the work is to be performed.

The preferred embodiment of the present invention comprises three core components: legs, stretchers (cross-members), and a tensioning device. The preferred embodiment also includes precision wood joinery. Said precision wood joinery imparts greatly increased vertical, horizontal, and lateral stability and strength.

The preferred embodiment includes four identical legs four identical stretchers (cross members), and a tensioning strap and buckle. A disposable top rail supports the work piece. The legs and stretchers interlock by virtue of dados. Each leg has two dados on its front edge to receive the two stretchers. The stretchers have a dado at each end to receive the legs. The stretchers are fastened to the legs by wood screws and glue. The intersecting angle of all stretchers and legs is 90 degrees—a right angle. The legs are substantially parallel to one another, and the stretchers are substantially parallel to one another.

The two halves of the sawhorse are attached to one another by a pair of nuts and bolts that pass through holes which are drilled through the upper portion of the legs, so that the left leg of one half is bolted to the right leg of the second half. The bolts then serve as hinges, allowing the two halves to open and close in a pliers-like fashion. Notches are machined into the upper ends of the legs to receive a sacrificial top rail that is made of "two-by" lumber. When the leg pairs are drawn together at the bottom, the notches on the upper ends of the legs clamp in a pliers-like fashion the "two-by" top rail that has been inserted into the notches. Because the left and right legs of each half of the sawhorse are joined together by stretchers, the legs open and close simultaneously. In the preferred embodiment, the angle between the two halves of the sawhorse is 45 degrees, but slight deviations from this can also achieve satisfactory results.

The leg pairs are pulled open by hand, but the force to close them is exerted by a tensioning device. In the preferred embodiment the tensioning device is a strap that joins the lower stretcher of the sawhorse halves. The tensioning force between the stretchers is transferred to the legs by tightening the strap, thus exerting a closing force on the legs and a pliers-like clamping force on the top rail by the notches at the tops of the legs. The strap utilizes a locking buckle to maintain the closing force on the legs and the clamping force on the top rail during use. The disposable top rail transmits the weight of the work piece onto the lower surface of the notch in the legs and thence to the entire leg.

The working height of the sawhorse can be varied by changing the size of lumber being used as the top rail. For example, using a 2×4 top rail, the working height might be 30". With a 2×6 top rail, the working height is increased to 32". And with a 2×8 top rail, the work height is increased to nearly 34". The preferred embodiment also includes a hinge hole, which receives a hinge bolt. A top rail fits into the notch created by the manner of arranging the hinge.

Precision wood joinery produces greater vertical strength and lateral (or racking) strength by preventing joints of the sawhorse from flexing. The wood joinery of the stretchers and legs unifies each) half of the sawhorse for unequaled lateral strength. This permits lighter weight lumber to be used in its construction, reduces the folded profile, and greatly increases portability.

In the preferred embodiment all wooden pieces of the sawhorse are milled such that the grain of the wood runs along the long portion of the piece. For example, in the legs the wood is milled such that the wood grains run from the floor to the top rail. Therefore, wood pieces include only substantially straight, parallel wood grains. Also, the preferred embodiment includes small, tight knots in the wood, thereby adding strength to the wood. In alternate embodiments wood with knots or other natural imperfections are rejected.

Alternate embodiments utilize different dimensions for the notch at the top of the leg and for the location of the hinge hole.

All wood pieces of the preferred embodiment are made of 0.75-inch by 3.5-inch lumber, and weigh a total of approximately 15 pounds. Two of these sawhorses, totaling thirty pounds of portable sawhorses, hold a 5,000 pound pickup truck off the ground. One sawhorse of this embodiment safely and stably holds over 2900 pounds of weight. This is a strength-to-weight ratio of nearly 200:1. This achievement constitutes a highly significant structural engineering event.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

It is to be understood that both the foregoing general description and the following detailed description provide embodiments of the invention and are intended to provide an overview or framework of understanding the nature and character of the invention as it is claimed.

DESCRIPTION OF THE DRAWINGS

FIG. 1 is an isometric view of a fully assembled sawhorse with a disposable top rail in place.

FIG. 2 is a fully assembled sawhorse in the folded position with no top rail and no tensioning strap.

FIG. 3 is an assembled sawhorse half.

FIG. 4 is an exploded view of an upper leg and two stretchers and their interlocking dados.

DETAILED DESCRIPTION OF THE INVENTION

The present invention is directed to an extremely strong, lightweight, folding wooden sawhorse with a sacrificial top rail, which is described more fully hereinafter.

This invention may be embodied in many different forms and should not be construed as limited to the specific embodiments described herein. While the present invention is described herein in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

Figure 1:
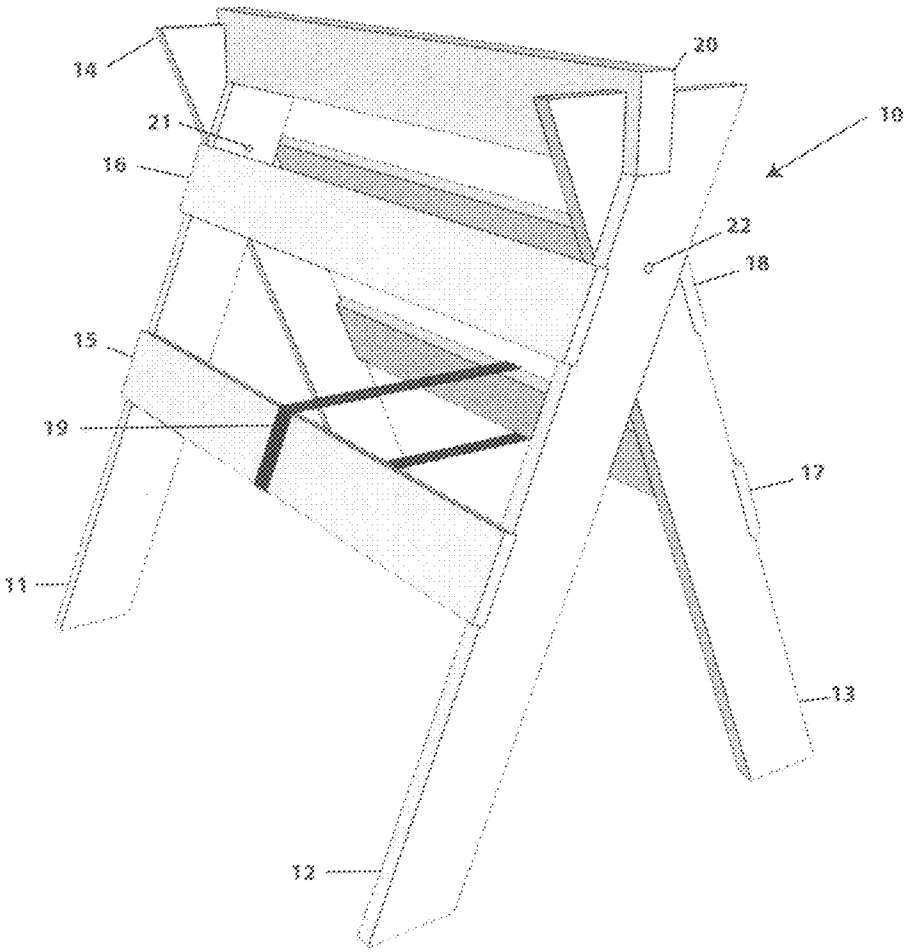
FIGS. 1-4 disclose the preferred embodiment of the instant sawhorse.

FIG. 1 is an isometric view of a fully assembled sawhorse [10] with a disposable top rail in place. The sawhorse [10] includes four identical legs [11], [12], [13], [14], four identical stretchers (cross members) [15], [16], [17], [18], and a tensioning strap and buckle [19] (buckle not shown). A disposable top rail [20] supports the work piece. Holes [21] and [22] each receive a nut and bolt assembly creating two joints that are in line with each other. The sawhorse halves are attached to one another by the pair of nut-and-bolt assemblies (not shown) that pass through holes [21] and [22]. When fully assembled the left leg [11] of one half of the sawhorse is bolted to the right leg [14] of the other half. The bolts then serve as hinges, in line with each other allowing the two halves to open and close in a pliers-like fashion. In the preferred embodiment the angle between the two halves of the sawhorse is 45 degrees.

Because the left and right legs (e.g., [11], [12]) of each half of the sawhorse are joined together by stretchers (e.g., [15], [16]), the legs open and close simultaneously. The leg pairs [11]-[12] & [13]-[14] are pulled open by hand. However, the force to close them is exerted by tightening the strap [19] that joins the lower stretcher [15], [17] of the sawhorse half. The tensioning force between the stretchers [15], [17] is transferred to the legs [11], [12], [13], [14], thus exerting a closing force on the legs [11], [12], [13], [14] and a pliers-like clamping force on the top rail [20] at the tops of the legs [11], [12], [13], [14]. The strap [19] utilizes a locking buckle (not shown) to maintain the closing force on the legs [11], [12], [13], [14] and the clamping force on the top rail [20] during use. The disposable top rail [20] transmits the weight of the workpiece onto the legs [11], [12], [13], [14]. The working height of the sawhorse can be varied by changing the size of lumber being used as the top rail [20]. For example, using a 2×4 top rail, the working height is 30", while a 2×6 top rail raises the working height to 32", and a 2×8 top rail raises the work height to nearly 34".

Figure 2:
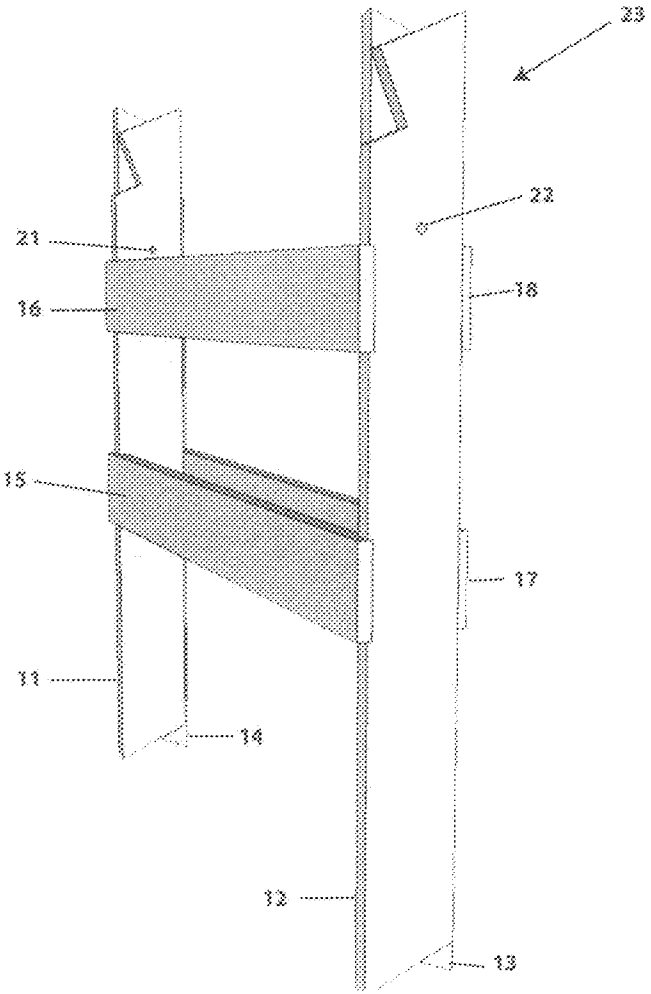

FIG. 2 is an assembled sawhorse [23] in the folded position without a strap & buckle assembly and without a top rail. Legs [11], [12], [13], [14] and stretchers [15], [16], [17], [18] are in their folded configuration.

Figure 3:
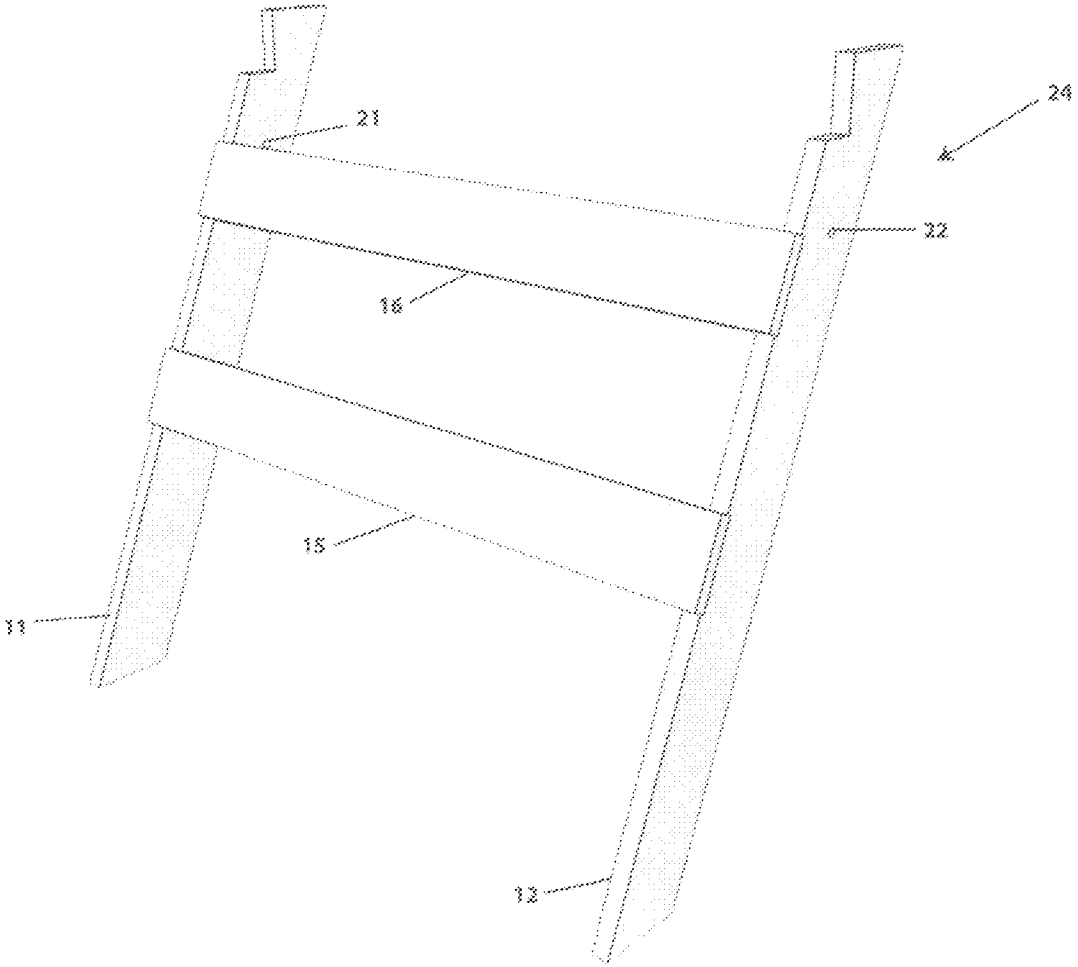

FIG. 3 is one half of an assembled sawhorse. The legs [11], [12] and stretchers [15], [16] are assembled into a sawhorse half [24], with the half consisting of two legs [11], [12] and two stretchers [15], [16]—a left leg [11], a right leg [12], a lower stretcher [15], and an upper stretcher [16]. The intersecting angle of the stretchers [15], [16] and legs [11], [12] is 90 degrees—a right angle. The legs [11], [12] are substantially parallel to one another, and the stretchers [15], [16] are substantially parallel to one another. Both halves of a fully assembled sawhorse are substantially identical.

Figure 4:
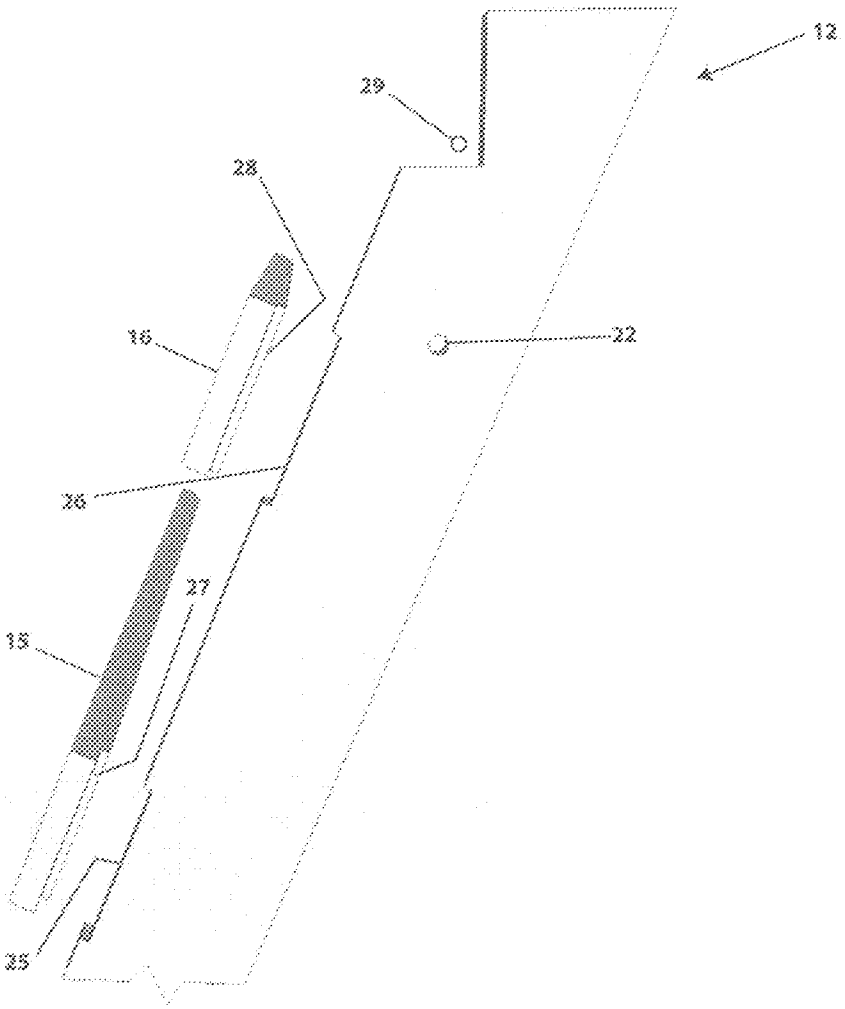

FIG. 4 is an exploded side view of a leg [12] and two stretchers [15], [16] and their interlocking dados [25], [26]. Each leg [12] has two dados [25], [26] on its front edge to receive the two stretchers [15], [16]. The stretchers [15], [16] each have a dado [27], [28] at each end of the stretchers [15], [16] to receive the legs [12]. The legs [12] and stretchers [15], [16] interlock by virtue of their dados [25], [26], [27], [28]. The stretchers [15], [16] are fastened to the legs [12] by wood screws and glue (not shown). This accounts for the extraordinary rigidity of the instant invention. The hinge hole [22] receives the hinge bolt. In the preferred embodiment a notch [29] is machined into the upper end of the leg [12] to receive a sacrificial top rail [20] that is made of "two-by" lumber, as represented in FIG. 1. When the leg pairs [12] are drawn together at the bottom, also represented in FIG. 1, the notches [29] on the upper ends of the legs [11], [12] [13], [14] clamp in a pliers-like fashion the "two-by" top rail [20] that has been inserted into the notches [29]. In the preferred embodiment the notch [29] is a 90 degree cut, set 22.5 degrees above perpendicular to the edge of the leg [12].

What is claimed is:

1. A folding sawhorse comprising: a first half comprising a first leg and a second leg, said first leg and said second leg statically connected by a first upper stretcher and a first lower stretcher, wherein each of said legs and said stretchers include dados for joining said stretcher faces to said legs, and wherein said stretchers run substantially parallel to a removable top rail; a second half identical to said first half, said second half attached to said first half in an orientation rotated 180 degrees in respect to said first half, a first joint movably connecting said first half with said second half; a second joint in line with said first joint, movably connecting said first half with said second half; a notch at a top of each of said legs; a tensioning means between said first half and said second half; and wherein said removable top rail spans between said notches.

2. The sawhorse of claim 1 further comprising a tensioning means between said first half and said second half, wherein said tensioning means pulls said first lower stretcher and said second lower stretcher together while simultaneously causing said notches to tighten on said removable top rail.

3. The sawhorse of claim 1 wherein said dados are joined such that one surface of each of said stretcher faces is substantially flush with one edge of said legs.

4. The sawhorse of claim 1 wherein said legs and said stretchers consist of lumber no larger than 0.75 inches deep by 3.5 inches wide.

5. The sawhorse of claim 1 wherein said notch is oriented such that said top rail rests perpendicular to a long width of said legs.

6. The sawhorse of claim 1 wherein said first half and said second half are configured to have an angle of 45 degrees between said halves.

7. The sawhorse of claim 1 wherein said legs include an angled lower portion configured to be parallel to a resting surface.

8. The sawhorse of claim 1 wherein said legs and said stretchers are made of wood with substantially straight grain running along a long portion of said stretchers and said legs.

9. The sawhorse of claim 1 wherein said sawhorse weighs less than 16 pounds.

10. A strong, lightweight, folding sawhorse comprising: a first half comprising a first leg and a second leg, said first leg and said second leg being substantially identical, said first leg, and said second leg being substantially parallel, said first leg and said second leg statically connected by a first upper stretcher and a first lower stretcher, said first upper stretcher and said first lower stretcher being substantially identical, said first upper stretcher and said first lower stretcher being substantially parallel, wherein each of said first upper stretcher and said first lower stretcher are attached to both said first leg and said second leg at four points of attachment, and wherein each of said points of attachment include dados for joining said stretcher faces to said legs edge, and wherein said stretchers run substantially parallel to a removable top rail; a second half comprising a third leg and a fourth leg, said third leg and said fourth leg being substantially identical, said third leg and said fourth leg being substantially parallel, said third leg and said fourth leg statically connected by a second upper stretcher and a second lower stretcher, said second upper stretcher and said second lower stretcher being substantially identical, said second upper stretcher and said second lower stretcher being substantially parallel, wherein said second upper stretcher and said second lower stretcher are attached to both said third leg and said fourth leg at four points of attachment, and wherein each of said paints of attachment include dados for joining said stretcher faces to said legs edge, and wherein said stretchers run substantially parallel to said removable top rail; a first joint movably connecting said first half with said second half at said first leg and said third leg; a second joint in line with said first joint, movably connecting said first half with said second half at said second leg and said fourth leg; a notch at the top of each of said legs; a tensioning means between said first half and said second half; and wherein said removable top rail spans between said notches.

11. The sawhorse of claim 10 further comprising a tensioning means between said first half and said second half, wherein said tensioning means pulls said first lower stretcher and said second lower stretcher together while simultaneously causing said notches to tighten on said removable top rail.

12. The sawhorse of claim 10 wherein said tensioning means is a strap wrapped around said first lower stretcher and said second lower stretcher.

13. The sawhorse of claim 10 wherein said dados are joined such that one surface of each of said stretcher faces is substantially flush with one edge of said legs.

14. The sawhorse of claim 13 wherein said legs and said stretchers are made of 0.75 inch by 3.5 inch lumber.

15. The sawhorse of claim 10 wherein said four points of attachment are joined such that one surface of each of said stretcher faces is substantially flush with one edge of said legs.

16. The sawhorse of claim 10 wherein said legs and said stretchers are made of wood with substantially straight grain running along the long portion of said stretchers and said legs.

17. The sawhorse of claim 10 wherein said dados consist of cuts into said leg edges no deeper than 0.75 inches.

* * * * *